United States Patent [19]

Birkeland

[11] Patent Number: 4,474,130

[45] Date of Patent: Oct. 2, 1984

[54] HELICOPTER DECK PREFERABLY FOR USE IN OFFSHORE OIL DRILLING PRODUCTION PLATFORMS

[76] Inventor: Magnus Birkeland, 4934 Nesgrenda, Norway

[21] Appl. No.: 460,234

[22] PCT Filed: Jun. 15, 1982

[86] PCT No.: PCT/NO82/00034

§ 371 Date: Jan. 17, 1983

§ 102(e) Date: Jan. 17, 1983

[87] PCT Pub. No.: WO82/04427

PCT Pub. Date: Dec. 23, 1982

[30] Foreign Application Priority Data

Jun. 15, 1981 [NO] Norway ..... 812021

[51] Int. Cl.[3] ..... B63B 35/44

[52] U.S. Cl. ..... 114/258; 244/114 R

[58] Field of Search ..... 114/183 R, 85, 258, 114/261, 264, 265; 169/15, 16, 44, 54, 62, 67; 244/114 R; 404/36; 15/DIG. 2

[56] References Cited

U.S. PATENT DOCUMENTS

| | | | |
|---|---|---|---|
| 3,063,502 | 11/1962 | Lakind | 244/114 R |
| 3,142,460 | 7/1964 | Langford | 244/114 R |
| 4,181,179 | 1/1980 | Batte | 244/114 R |
| 4,202,646 | 5/1980 | Herstad | 244/114 R |

*Primary Examiner*—Trygve M. Blix
*Assistant Examiner*—Jesûs D. Sotelo
*Attorney, Agent, or Firm*—Ladas & Parry

[57] ABSTRACT

A helicopter deck (1) preferably for use on offshore oil drilling/production platforms and provided with a fire extinguishing system. The periphery of the deck is provided with a gutter (2) having one, and preferably several, down pipes (3) distributed around the periphery of the deck. Centrally in the deck, water discharge orifices (4) are provided, supplied with water under pressure for flooding the deck surface (5). Control levers (6) are arranged at the periphery of the deck for controlling the supply of water under pressure to the water discharge orifices (4) via valves. On the surface of the deck (5), a grate (7) is provided, preferably subdivided into grate sector units (10') comprising parallel diagonal ribs (8) which together with diagonal ribs in adjacent grate sector units (10') surround the water discharge orifices (4). Each diagonal rib (8) forms an acute angle relative to the deck surface (5), the angle facing toward the water discharge orifices (4), said ribs being supported and spaced a distance above the deck surface (5) by spacer members (9) which form watertight walls dividing the deck surface (5) into sectors (10). The water discharge orifices discharge in a horizontal, radial direction beneath the diagonal ribs (8).

9 Claims, 2 Drawing Figures

HELICOPTER DECK PREFERABLY FOR USE IN OFFSHORE OIL DRILLING PRODUCTION PLATFORMS

Figure 1:
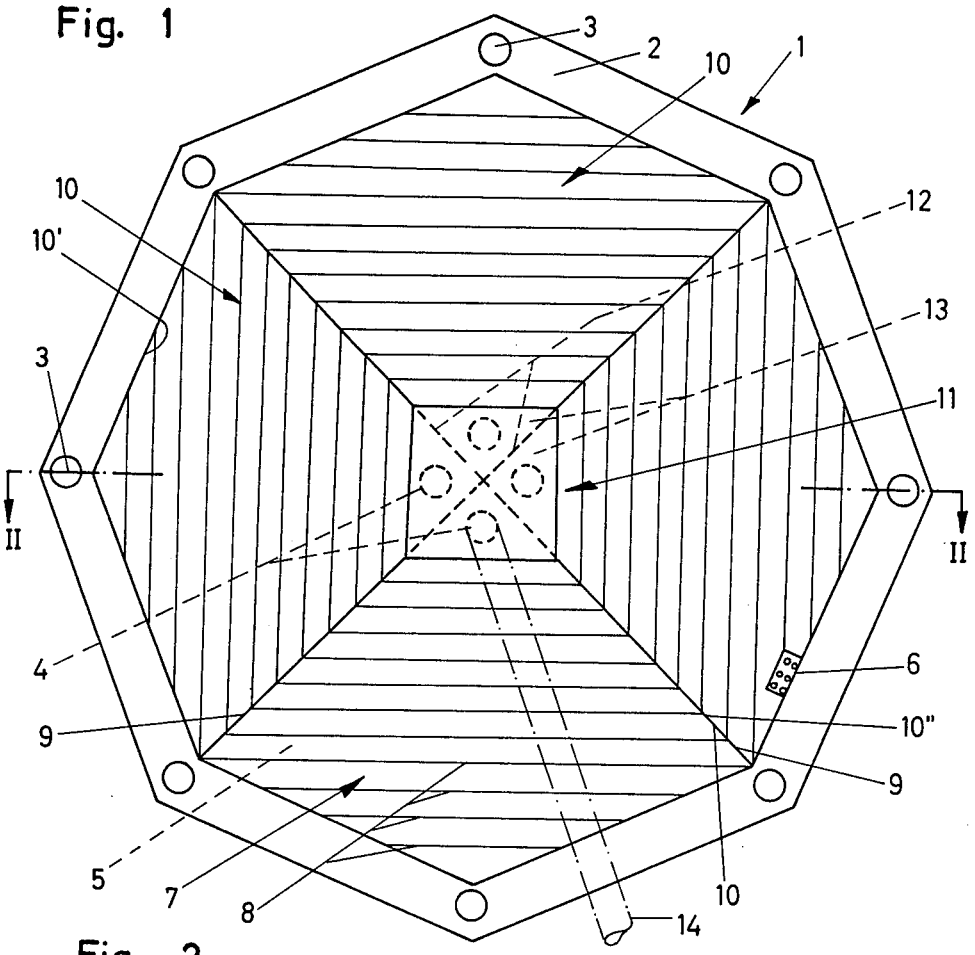

The present invention relates to a helicopter deck, preferably for use on offshore oil drilling/production platforms, of the type recited in the preamble of the appurtenant claim 1.

A helicopter deck of this type is known from applicant's Norwegian Pat. No. 146,532 issued Oct. 20, 1982. In accordance with the invention disclosed therein, the flammable or perhaps burning fluid or other substances are removed from the area underneath and around a helicopter which has crash-landed and conveyed to the peripheral regions of the helicopter deck. This is done by supplying large quantities of water from water discharge orifices in the central area of the helicopter deck, which flush said burning or combustible fluid and other substances away from the central area of the deck into a gutter surrounding the helicopter deck, which is provided with a plurality of down pipes in which the burning fluid will become extinguished due to lack of oxygen and run out with the water into the sea. The down pipes preferably extend almost to the surface of the water, and the great height of fall in the down pipes, assuming that the pipes have a sufficiently large cross section, will effect good drainage of the gutter around the helicopter deck.

In accordance with said patent, it is suggested that radially extending guide ribs be provided at the water discharge orifices for the purpose of ensuring a uniform distribution of the water flowing out over the surface of the deck. The deck surface may assume an inclined position owing to movements of the platform, and in the absence of such guide ribs, portions of the helicopter deck would obtain little or no flooding. This is particularly true when the supply of water has been reduced after the fire has been extinguished, water then being supplied only for the purpose of ensuring final removal of any dripping combustible liquid from the helicopter.

Other factors also affect the water flow. In high winds, the flow of water in a certain direction from the water discharge orifices might become weakened or partially cut off, because the force of the wind could cause the current of water to split so that some areas might not be sufficiently flooded, of head winds could drive a rather broad section of the water back toward the center of the deck.

Under certain conditions, for example if the crashed helicopter has landed off-center on the deck, it may be vital to direct all or a substantial portion of the water flow to one or more sectors of the deck where the helicopter is located, to ensure that enough water is provided at that location to flush flammable or burning fluids away from the helicopter.

The object of the present invention is to reduce the influence of wind on the flow of water from the central region of the deck, and to enable the flow of water to be controlled and guided to desired sections, i.e., sectors, of the deck. This is achieved in accordance with the present invention by means of the features recited in the characterizing clause of the appurtenant claim 1 and the succeeding claims.

By providing, in accordance with the invention, a grate comprising diagonally-disposed ribs spaced a distance above the surface of the deck, with the acute angle formed by the ribs and the surface of the deck facing toward the water discharge orifices in the central section of the deck, the force of the wind on the windward side of the deck, i.e., the side from which the wind is blowing, on the water flowing from the central section of the deck toward its periphery is substantially reduced, since the wind strikes against the inclined ribs and is deflected by these in a direction along the top surface of the ribs.

On the opposite side of the deck, the lee side, the wind will encounter the upper edge of the inclined ribs and may be guided down toward the surface of the deck and out toward the periphery of the deck, which will drive the flowing water outwardly toward the deck periphery and thus increase its rate of flow. In the sections or sectors of the deck which are crosswise to the wind direction, a blending of the above two effects can occur so that the effect of the wind on the outflowing water in these sectors, too, will be substantially reduced.

By subdividing the deck surface into sectors by means of radially extending spacer members which form watertight walls and which support the grates, and by providing a water discharge orifice at the apex portion of each sector, it is possible to direct the flow of water, utilizing control levers which operate valves in the delivery pipes which convey water under pressure to the water discharge orifices, so that the water supply can be shut off or opened to the various sectors depending on the location on deck of the damaged helicopter.

Because the grate with the diagonal ribs is divided into sector units, such grate sector units may be prefabricated, if desired, and thereafter installed on the deck surface of the helicopter deck. Thus, an already existing helicopter deck can be equipped with central water discharge orifices, delivery pipes for water being placed on top of the existing deck surface, and the sector grate units can then be installed on top of the delivery pipes and the water discharge orifices. That is, an existing helicopter deck can be modified in a relatively simple and inexpensive manner to include the new fire extinguishing system having a central water supply for flooding the deck surface to flush away dripping and possibly burning fluid from a helicopter which has crashed on deck.

Figure 2:
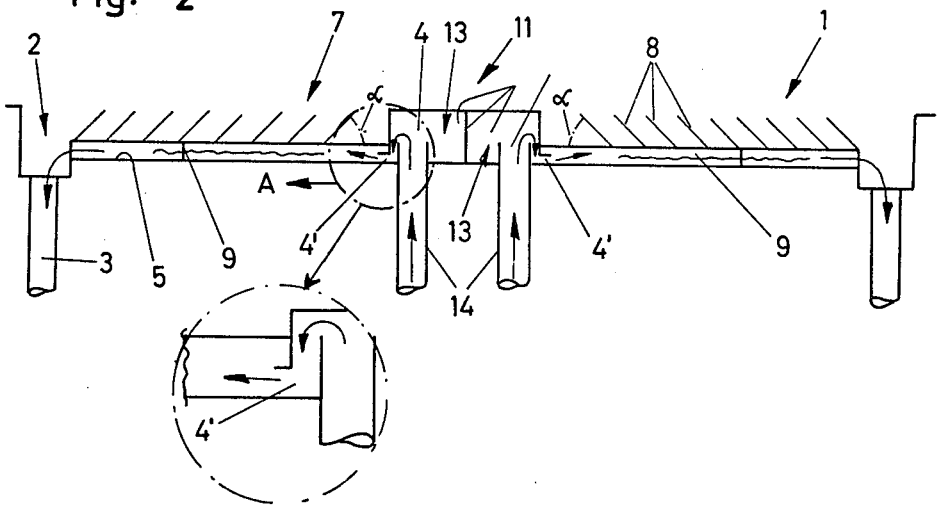

An embodiment example of the invention will be described in the following with reference to the accompanying drawings, wherein FIG. 1 is a schematic drawing of an octagonal helicopter deck in plan view, subdivided into four grate sections, and FIG. 2 is a cross section of the helicopter deck along the line II—II in FIG. 1.

The helicopter deck 1, as seen from the top in FIG. 1 and in cross section in FIG. 2, is of octagonal configuration and is provided at its periphery with a gutter 2 with a plurality of down pipes 3 distributed around the periphery of the deck. Disposed centrally in the deck are water discharge orifices 4, supplied with water under pressure via delivery pipes 14 which in FIG. 2 are shown disposed vertically and centrally in the deck. Alternately, as shown with the broken lines in FIG. 1, the delivery pipes 14 can be guided from the peripheral section of the deck to the water discharge orifices 4 at the center. At the periphery of the deck, a panel with control levers 6 is provided for controlling the supply of water under pressure to the discharge orifices 4 via valves preferably disposed in the delivery pipes 14. Provided on the watertight deck surface 5 of the helicopter deck is a grate 7 consisting of diagonal ribs 8 spaced apart from the deck surface 5 and surrounding the water discharge orifices 4. Each rib 8 forms an acute angle relative to the deck surface 5, the angle $\alpha$ facing toward the water discharge orifices 4. The ribs 8 are supported and spaced a distance above the deck by means of spacer members 9 which form watertight walls and divide the deck surface 5 into sectors 10. At the tip of each sector, a water discharge orifice 4 is provided which discharges at a level beneath the diagonal ribs 8 of the grate 7.

In the illustrated embodiment, the grate 7 is divided into four sectors 10, each sector 10 forming a sector grate unit 10' whose adjacent edges 10'' comprise the above-mentioned spacer members 9 which form watertight walls dividing the deck surface 5 with the grate 7 into sectors 10. Each grate sector 10 thereby forms a unit which may be prefabricated and placed on the deck surface 5 for connection to adjacent grate sector units 10'. By providing a water discharge orifice 4 in each sector 10 which discharges at a level beneath the diagonal ribs 8 of the grate 7, water can be supplied via the delivery pipes 14 to one or more sectors simultaneously, as needed, thereby enabling one to obtain the greatest effect of the resulting flow of water from the central region of the deck out of the gutter 2 at its periphery, for extinguishing or washing away flammable or possibly burning fluid from a crashed helicopter.

In their simplest form, the discharge orifices 4 can constitute end sections of the delivery pipes 14 which extend radially toward the periphery of the deck, thus providing a horizontal, radially directed flow of water in each individual sector 10.

The end section of the delivery pipe 14 can also be provided with a cross pipe with closed ends, having smaller orifices or slits in the pipe wall directed horizontally outwardly toward the periphery of the deck. One thereby obtains a distribution of the water flow within the sector, which may be of importance if the water supply is reduced to a thin layer of flowing water, for example for rinsing off any dripping flammable fluids. Both of the above-mentioned embodiments of the water discharge orifices at the end section of the delivery pipe 14 can be used either with a central, vertically disposed delivery pipe as shown in FIG. 2 or with horizontally disposed delivery pipes 14 as indicated by the broken lines in FIG. 1. The only limitation is that the components which form the water discharge orifices must not project up higher than the upper margin of the diagonal ribs 8.

In the embodiment illustrated in FIG. 2, the water discharge orifices 4 which actually constitute nothing more than the end opening of the delivery pipes 14, may be built into a central head 11 whose upper margin is in alignment with the upper level of the grate 7 and which is subdivided by partitions 12 into a plurality of compartments 13 corresponding to the number of grate sectors 10. Said compartments 13 in this case constitute the apex section of the grate sector 10. A delivery pipe 14 opens out into each compartment, and each compartment 13 is provided with a horizontal water discharge orifice 4' which discharges at a level beneath the lower margin of the diagonal ribs 8.

With such an embodiment, wherein the water discharge orifices 4,4' form part of a central head 11, the portion of the head 11 which covers a sector 10 may be made as part of the corresponding grate sector unit 10'. In this manner, the grate sector units 10' may be prefabricated with each sector having its portion of the central head 11 arranged at the apex of the grate sector unit, the completed head 11 then being provided upon placing/installing the grate sector units 10' on the helicopter deck.

The control of the valves (not illustrated) in the delivery pipes 14 for obtaining partial or complete flooding of the deck surface 5, as mentioned previously, may be performed from a panel with operating levers 6; such control may be provided in a number of ways, known per se, which will be familiar to a skilled person.

I claim:

1. A helicopter deck (1) preferably for use on offshore oil drilling/production platforms and provided with a fire extinguishing system, said deck having a plurality of down pipes (3) distributed around the periphery of the deck, water discharge orifices (4) disposed centrally in the deck and supplied with water under pressure for flooding the deck surface (5), and control levers (6) disposed at the periphery of the deck for controlling the supply of water under pressure to the water discharge orifices (4) via valves, characterized in that a grate (7) is provided on the deck surface (5), having diagonal ribs (8) spaced a distance above the deck surface (5) and surrounding the water discharge orifices (4), each said rib forming an acute angle relative to the deck surface (5) with the angle ($\alpha$) facing toward the water discharge orifices (4), said ribs (8) being supported by radially extending spacer members (9) on the deck surface (5).

2. A helicopter deck according to claim 1, characterized in that at least three of said spacer members (9) form watertight walls which divide the deck surface (5) into sectors (10).

3. A helicopter deck according to claim 2, characterized in that the diagonal ribs (8) form polygons with mutually parallel edges surrounding the central section of the deck with the water discharge orifices (4), and that each section of the grate (7) having mutually parallel ribs (8) forms a sector (10).

4. A helicopter deck according to claim 3, characterized in that each grate sector (10) constitutes a unit (10') for connection to adjacent grate sector units (10').

5. A helicopter deck according to claim 4, characterized in that adjacent edges (10'') of the grate sector units (10') comprise said spacer members (9) which form the watertight walls.

6. A helicopter deck according to claim 1, characterized in that water discharge orifices (4) discharge at a level beneath the diagonal ribs (8) of the grate (7) in a horizontal direction of flow (A).

7. A helicopter deck according to claim 6, characterized in that one water discharge orifice (4) if provided for each grate sector (10).

8. A helicopter deck according to claim 7, charcterized in that each water discharge orifice (4) comprises a horizontal cross pipe on the end of a delivery pipe (14), said cross pipe being closed at the ends thereof and provided with water discharge orifice(s) (4') facing outwardly toward the periphery of the deck.

9. A helicopter deck according to claim 6, characterized in that the water discharge orifices (4) form part of a central head (11) whose upper margin is in alignment with the upper level of the grate (7) and which is divided by partitions (12) into a plurality of compartments (13) corresponding to the number of grate sectors (10) and located at the apex portion of the grate sectors, each compartment being provided with a horizontal water discharge orifice (4') communicating with a delivery pipe (14) with a water discharge orifice (4).

* * * * *